US007744131B2

(12) United States Patent
Urbanek

(10) Patent No.: US 7,744,131 B2
(45) Date of Patent: Jun. 29, 2010

(54) ONE-PIECE LABEL WITH INTEGRAL TEAR STRIP

(75) Inventor: Debra A. Urbanek, Augusta, KS (US)

(73) Assignee: Corporate Express US Inc., Broomfield, CO (US)

( * ) Notice: Subject to any disclaimer, the term of this patent is extended or adjusted under 35 U.S.C. 154(b) by 34 days.

(21) Appl. No.: 11/868,098

(22) Filed: Oct. 5, 2007

(65) Prior Publication Data

US 2009/0091121 A1 Apr. 9, 2009

(51) Int. Cl.
*B42D 15/00* (2006.01)
*B65D 65/28* (2006.01)
*G09F 3/00* (2006.01)

(52) U.S. Cl. ..... 283/81; 283/103; 283/100; 283/101; 283/105; 283/56; 283/117; 428/43

(58) Field of Classification Search ..... 206/308.2, 206/800, 807; 283/81; 428/187, 207, 343, 428/401, 411.1, 500, 507; *B32B 3/00, 9/00; B65D 27/04, B65D 27/06, 85/57*

See application file for complete search history.

(56) References Cited

U.S. PATENT DOCUMENTS

| | | | | |
|---|---|---|---|---|
| 3,175,752 | A | | 3/1965 | Stabenow |
| 3,179,326 | A | | 4/1965 | Underwood et al. |
| 3,187,982 | A | | 6/1965 | Underwood et al. |
| 3,302,856 | A | | 2/1967 | Thompson et al. |
| 3,344,975 | A | | 10/1967 | Stoker, Jr. |
| 3,668,061 | A | | 6/1972 | Forman |
| 3,980,224 | A | | 9/1976 | Yasuda |
| 4,098,406 | A | | 7/1978 | Otten et al. |
| 4,781,294 | A | | 11/1988 | Croce |
| 4,903,842 | A | | 2/1990 | Tokuda et al. |
| 5,186,782 | A | | 2/1993 | Freedman |
| 5,203,634 | A | | 4/1993 | Kim |
| 5,203,935 | A | | 4/1993 | May et al. |
| 5,480,700 | A | * | 1/1996 | Kume et al. ..... 428/195.1 |
| 5,704,648 | A | * | 1/1998 | Brown et al. ..... 283/81 |
| 5,826,787 | A | * | 10/1998 | Turner ..... 229/303 |
| 5,897,052 | A | | 4/1999 | Tanaka et al. |
| 6,394,500 | B1 | * | 5/2002 | Nixon et al. ..... 283/101 |
| 6,908,113 | B2 | | 6/2005 | Chaduc et al. |

(Continued)

FOREIGN PATENT DOCUMENTS

DE 10215830 10/2003

OTHER PUBLICATIONS

"Fasson® PRIMAX® 350/S692N/44# PK", available at http://na.fasson.com/frna/Prod_sht.nsf/frna/Prod_sht.nsf/3B0344E3052FF0CD85256C60005C67EF?OpenD..., Avery Dennison, printed Oct. 3, 2007, p. 1-3.

(Continued)

*Primary Examiner*—Dana Ross
*Assistant Examiner*—Justin V Lewis
(74) *Attorney, Agent, or Firm*—Sheridan Ross PC

(57) ABSTRACT

A one-piece adhesive label is provided incorporating an integral tear strip. The tear strip is formed as the user grasps one activation tab that resides on either opposite end of the label. Preferably, one tab is formed at each opposite end. Slits formed on the opposite ends of the label adjacent the tabs enable the label to be torn in a uniform manner, taking advantage of the particular material characteristics of the label sheet that has unidirectional fibers.

9 Claims, 2 Drawing Sheets

U.S. PATENT DOCUMENTS

2005/0045503 A1 * 3/2005 Wong et al. ..... 206/308.2

OTHER PUBLICATIONS

"Typical Properties of Polyolefin", available at http://www.ides.com/generics/Polyolefin/Polyolefin_typical_properties.htm, Copyright 1986-2007 IDES Inc., printed Oct. 3, 2007, 1 page.

"Polyolefin", available at http://www.factmonster.com/ipd/A0595045.html, Copyright 2000-2007 Pearson Education, printed Oct. 3, 2007, p. 1-2.

"Fast coloring of textile or industrial products with spundyed polyolefin fibers", available at http://www.swicofil.com/innocolorpolyolefinfiber.html, SWICOFIL, printed Oct. 3, 2007, p. 1-3.

* cited by examiner

ONE-PIECE LABEL WITH INTEGRAL TEAR STRIP

FIELD OF THE INVENTION

The present invention relates to adhesive labels, and more particularly, to a one-piece adhesive label having an integral tear strip.

BACKGROUND OF THE INVENTION

Adhesive labels are used to identify the contents of various packages, as well as to provide other information such as where the package is to be shipped, where the package originated, among other information. Whether a package is sent by courier, mail, or other package delivery services, adhesive labels are perhaps the most common way in which to identify the package so that it can be delivered to its proper destination. Many labels include pressure sensitive adhesive that allows the label to be easily applied to the package, yet the label remains secured to the package even under harsh shipping conditions.

Adhesive labels may also serve the dual purpose of securing adjacent closure flaps of the package, as well as to identify package contents and shipping information. These labels may be applied over the seam defining the edges of the closure flaps when folded to the closed position.

One disadvantage with respect to many prior art labels is that they require multiple layers of materials if the label is to include an integral tear strip enabling the package to be opened by grasping of the tear strip. Furthermore, multi-layer labels generally add to the costs of manufacturing the labels, as well as increasing the difficulty in manufacturing the labels since multiple materials are used and must be manipulated in the manufacturing process.

Therefore, there is a need to provide a label with an integral tear strip, but the label having a simplified yet reliable construction. There is also a need to provide an adhesive label that can serve the dual functions of identifying the package and securing adjacent closure flaps, yet achieving these functions at minimum cost.

SUMMARY OF THE INVENTION

In accordance with the present invention, a one-piece label is provided with an integral tear strip enabling a user to access the contents of a package by simply activating the tear strip that is incorporated on the same layer of material forming the label.

The one-piece label of the present invention is made from a single sheet of material wherein the sheet incorporates a material having fibers that extend linearly across the label. At least one activation tab extends from a side edge of the label. A pair of slits is made in the label sheet on opposite sides of the tab. When the user grasps the activation tab and pulls, the label can be torn in a consistent, predictable manner since the fibers of the label run in the same direction as the slits made at the side edge of the label. Thus, an integral tear strip can be provided by combining the material characteristics, the slits and the tab.

DETAILED DESCRIPTION OF THE INVENTION

Figure 1:
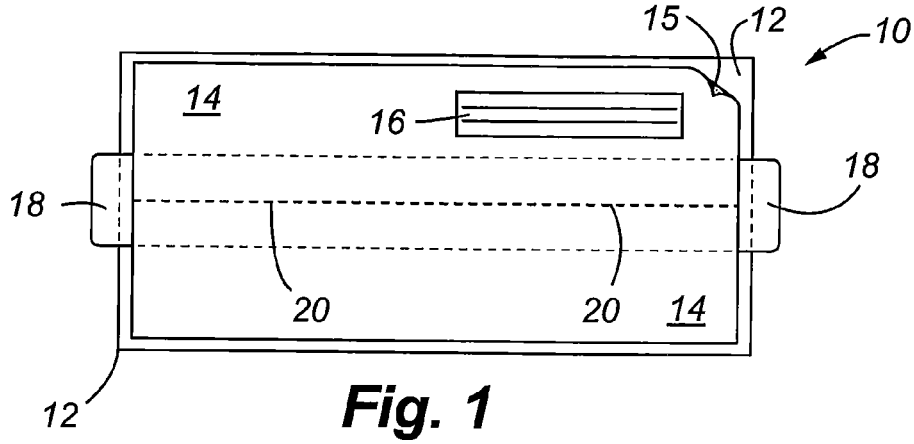
Fig. 1 Prior Art
FIG. 1 is a plan view of a prior art label.
Figure 2:
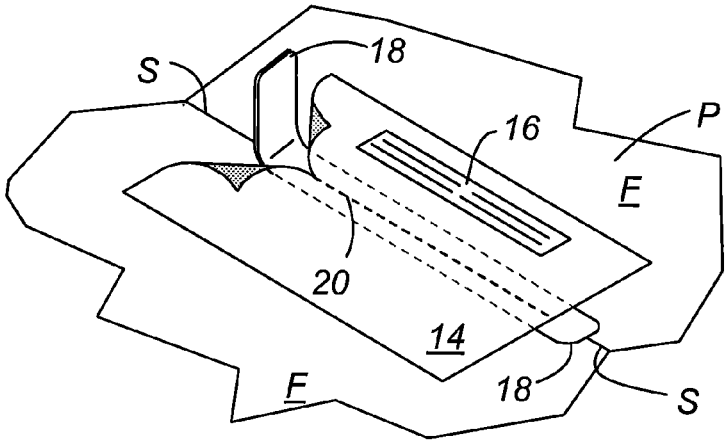
Fig. 2 Prior Art
FIG. 2 is a perspective view of the prior art label of FIG. 1 illustrating activation of a tear strip.

Referring first to the prior art shown in FIGS. 1 and 2, a conventional prior art label is shown with a tear strip formed from a separate piece of material. More specifically, the prior art label 10 may be stored on a liner sheet 12, and a tear strip 18 is sandwiched between the label sheet 14 and the liner sheet 12. The label sheet 12 may include an adhesive backing 15. The label sheet 14 is removed from the liner sheet 12 by separating one of the edges, as shown. The label 10 may further include a printed area 16 that identifies the package contents, where the package originated, where the package is to be shipped, and any other special instructions or identifying information. The tear strip 18 extends beyond opposite side edges of the label sheet, and typically at least one perforation or weakened area 20 is provided along the length of the label and overlying the tear strip 18.

Referring to FIG. 2, the prior art label 10 can be used to secure adjacent closure flaps F of a package P wherein the label 10 is centered over the seam S separating the flaps. If it is desired to access the contents of the package, a user grasps either end of the tear strip 18 and pulls such that the label sheet is separated along perforation line 20. Thus, with the prior art label, three components are required, namely, a liner sheet for storing of the label, a label sheet, and the tear strip 18. Furthermore, a line of weakness must be formed on the label sheet to allow uniform and predictable tearing.

Figure 3:
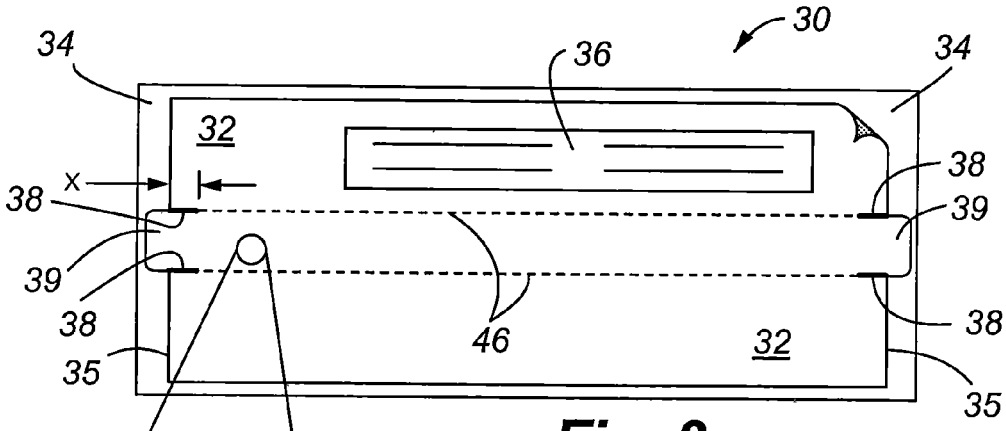
FIG. 3 is a plan view of the label of the present invention.

Referring now to FIG. 3, the present invention is illustrated as label 30 in accordance with a preferred embodiment of the present invention. A label sheet 32 has an exposed surface or face with a printed area 36 that can be used for identifying the package contents, shipment instructions, etc. The label sheet 32 is typically stored on a liner sheet 34. The label sheet 32 further includes a pair of activation tabs 39 that extend beyond the respective adjacent side edges 35 of the label sheet. The activation tabs are simply extensions of the label sheet and are not formed from separate material. A pair of tear slits or perforations 38 are formed at both adjacent side edges 35 of the label. Each pair of the tear slits extends substantially parallel to one another in the same direction along the label. Intended tear lines 46 represent the areas on the label sheet where tears are intended to occur when the user grasps the tabs 39. However, the intended tear lines are simply provided for visualizing where the label will tear when activated and no perforations or other types of weaknesses are formed on the label sheet. Therefore, the tear slits only extend upon a minor portion of a length of the label, and do not extend along a majority of the label. The intended tear lines extend linearly between corresponding slits of each pair of slits 38. Thus, the tear strip is a rectangular shaped element bisected by the seam S defining the gap between the closure flaps F. Preferably, the tear slits 38 do not penetrate the entire thickness of the label sheet 32 but weaken the label at the slits enough so that when a user grasps and pulls the corresponding tab 39, the label will tear. By not having the slits penetrate the entire thickness of the label sheet, the integrity of the label is better preserved to prevent inadvertent tears from occurring during shipment or storage of a package incorporating the label.

Figure 3A:
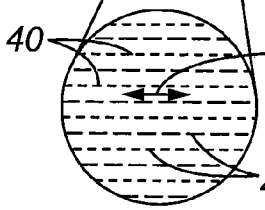
FIG. 3A is a greatly enlarged view of a portion of the label showing the linearly arranged fibers extending in a uniform direction.

One preferred material for use with the label sheet of the present invention is a Polyolefin that is extruded such that the fibers in the material extend linearly across the length of the label sheet. Referring to FIG. 3A, the fibers 40 are shown extending in the same direction or linear orientation D. One acceptable commercial material for the label sheet includes a polyolefin film sold by Fasson® known as Primax®. This material can be used when the material is oriented such that the fibers run the length of the label, that is, when the fibers are oriented such that they extend along the linear orientation D. The particular thickness of the label sheet can vary, but in one preferred embodiment of the present invention, the label sheet is substantially thicker than conventional labels. Most labels have a thickness of between about 2 to 5 mils. This thickness allows the labels to be manufactured in standard processing equipment. In this preferred embodiment however, the thickness is preferably about 8 mils that makes the label significantly more rigid than standard labels. Particularly for those labels that are to be manually applied, increasing the thickness of the label makes them easier to handle and also increases the strength of the label whereby use of the single label sheet is strong enough to seal most packages.

Figure 4:
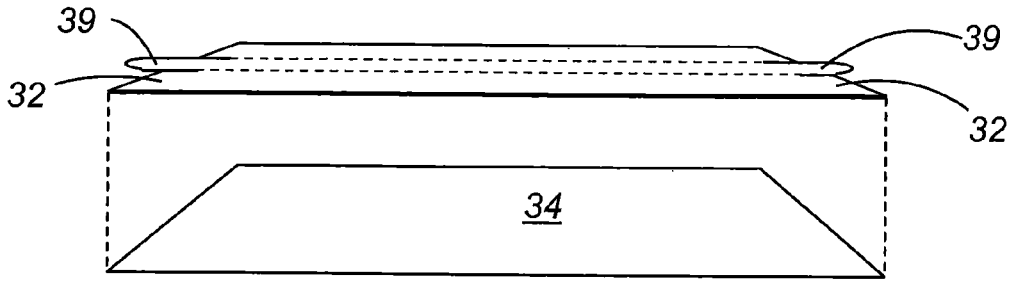
FIG. 4 is a perspective view of the label of the present invention wherein the label sheet has been separated from the liner sheet.

Referring to FIG. 4, label 30 is shown during manufacturing wherein the label sheet is simply a one-layer piece of material cut to a desired shape. Prior to use, the label sheet is attached to the linear sheet.

Figure 5:
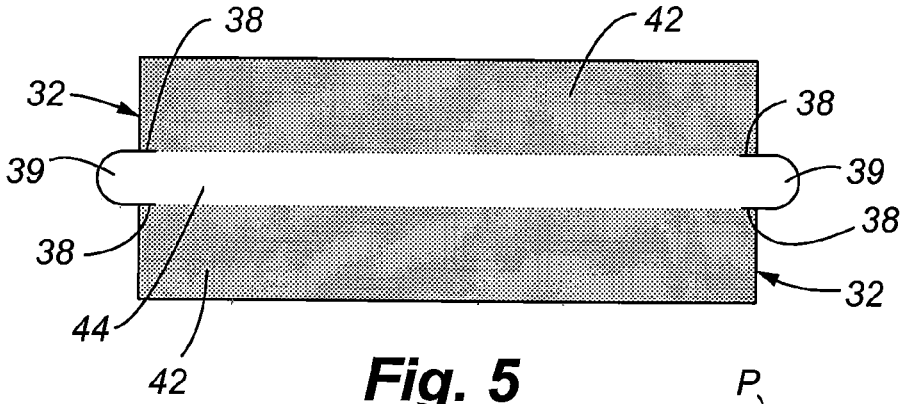
FIG. 5 is a reverse plan view of the label sheet of the present invention illustrating the adhesive pattern and deadened area.

Referring to FIG. 5, the lower surface or face of the label sheet is illustrated wherein adhesive 42 extends along both sides of the tabs 39. However, a deadened area 44 is formed on the lower surface where the adhesive has been deadened. One way in which this deadened area can be formed is to separate the label sheet from the liner sheet and then apply a chemical to deaden the desired area corresponding to the tear strip. The label sheet may then be re-secured to the liner sheet. Alternatively, when the label sheet is manufactured, the processing machinery that applies the adhesive can be controlled such that no adhesive is placed on the area 44. Accordingly, the terms "deadened area" as defined herein can define the neutralization of adhesive on the lower face of the label as a result of applying a chemical or the lack of adhesive being applied to that area.

Figure 6:
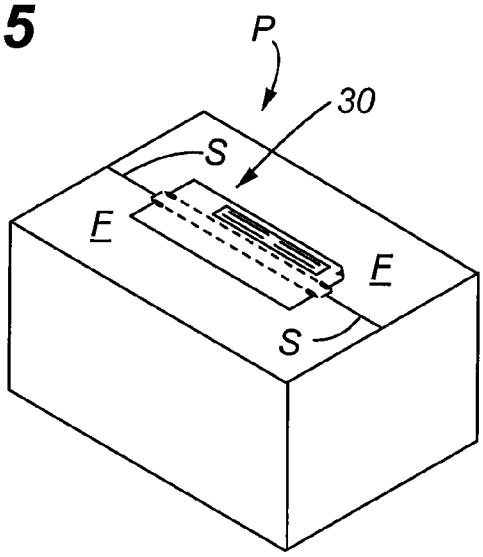
FIG. 6 is a perspective view of a package incorporating the label of the present invention.

Referring to FIG. 6, the label 30 of the present invention is shown applied to a package. As shown, the label is oriented along the seam S of the package such that the seam bisects the label.

Figure 7:
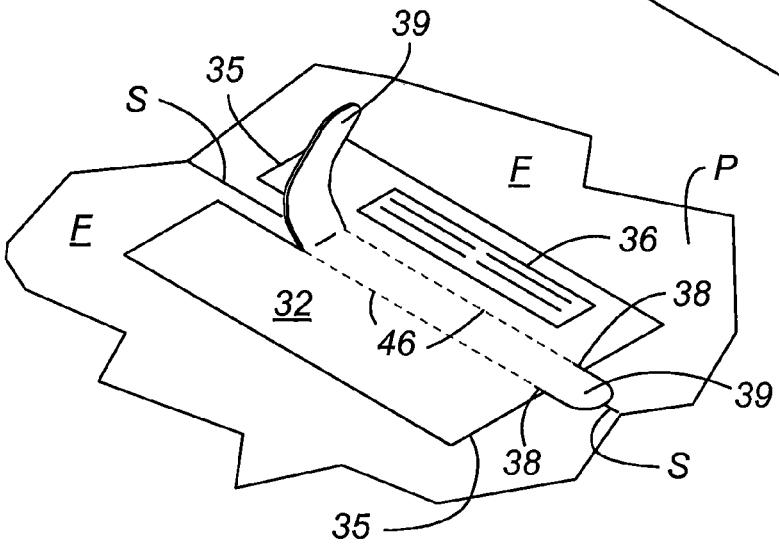
FIG. 7 is an enlarged perspective view of the label of the present invention illustrating the tear strip being formed by a user grasping an activation tab.

Referring to FIG. 7, access to the contents of the package occurs by grasping one of the tabs 39 and pulling upwards. As the user pulls, tears are naturally formed in the label sheet material along intended tear lines 46. The tear slits 38 enable the tears to commence without disruption of other parts of the label. The tear slits 38 can be of a selected length, but during testing it has been found that tear slits of 1/16" enable uniform and consistent commencement of the tears, yet do not compromise the overall structural integrity of the label. Although two tabs 39 are shown positioned at opposite ends of the label, it shall be understood that only one tab is required.

For the liner, preferably a lightweight, non-curl liner material is used that lends itself to continuous form, fan fold, roll or separate sheet-end product, depending on the printing application desired. A preferred method of printing the product information onto the label sheet may utilize impact, laser, thermal imaging or other techniques to assist in reducing the overall cost of the label. The lower or rear surface of the label sheet is preferably provided with a pressure-sensitive adhesive. Although many different types of adhesive can be used, it is contemplated that adhesive types may include a removable acrylic emulsion, a cold temperature acrylic emulsion, or a permanent acrylic emulsion. The adhesive selected will depend upon the particular application of the label. For example, permanent adhesion may be desired in one application whereas a repositionable adhesive may be more desirable in those uses that may require adjustment or moving of the label. In order to more easily facilitate deadening of the deadened area directly underneath the tear strip, a removable acrylic emulsion may be most desirable wherein application of a solvent easily removes the adhesive such that there is a clear delineating line between the remaining adhesive on the outer portions of the label sheet and the deadened area.

Depending upon the printing format desired, the liner sheet can be provided in a number of different final forms including a continuous sheet, separate smaller pages or sheets, continuous pin-fed sheet separated by perforated ends, and others. Thus, it is contemplated that labels of the present invention may be provided on a continuous roll, or may be separated into smaller pages or sheets.

To improve impact, laser, and thermal imaging of the printing, a top coating may be applied on the exposed surface of the label sheet. These top coatings may be water based, UV cured, solvent based, or others. In any event, it is desirable to provide the top coating such that the bonding characteristic of the coating does not overcome the user's ability to easily tear the label and, therefore, does not disturb the basic alignment and structure of the fibers of the label sheet that may otherwise prevent them from tearing in a uniform direction.

While the present invention has been described with respect to a preferred embodiment, it shall be understood that various other changes and modifications may be made to the invention in accordance with the scope of the claims appended hereto.

What is claimed is:

1. A label comprising:

a label sheet made of a single sheet of an extruded polymer having first and second faces, said second face having adhesive provided thereon for adhesively coupling the label to an object, said label sheet further having a first side edge and an opposite second side edge;

at least one tab formed from said label sheet and extending beyond one of said first and second side edges;

a pair of parallel spaced slits formed on the label sheet and intersecting opposite portions of the corresponding side edge where the tab extends from the label sheet, said pair of slits extending in a first direction, said slits collectively not extending upon a majority of a length of said label sheet;

printing applied to said first face;

a deadened area incorporated on said second face, said deadened area bounded by an area between tear lines formed when a user pulls said tab; and wherein said label sheet is made of the single sheet of the extruded polymer having fibers extending in the first direction and substantially parallel with said pair of slits.

2. A label as claimed in claim 1, wherein:

said at least one tab includes two tabs, one tab extending beyond said first side edge and said second tab extending beyond said second side edge, said tabs bisecting said label and extending along a longitudinal axis of said label.

3. A label, as claimed in claim 2, wherein:

said pair of parallel spaced slits includes two pairs of parallel spaced slits, one pair of parallel spaced slits formed on the first side edge, and the other pair of parallel spaced slits formed on the second side edge.

4. A label, as claimed in claim 1, wherein:

said material comprises an extruded Polyolefin.

5. A method of opening a package by removing a part of a label applied to the package, said method comprising the steps of:

providing a label sheet made of a single sheet of material having first and second faces, said second face having adhesive provided thereon for adhesively coupling the label to an object, said label sheet further having a first side edge and an opposite second side edge;

forming at least one tab from said label sheet and extending beyond one of said first and second side edges;

creating a pair of parallel spaced slits on the label sheet and intersecting opposite portions of the corresponding side edge where the tab extends from the label sheet, said pair of slits extending in a first direction, said slits collectively not extending upon a majority of a length of said label sheet;

wherein said label sheet is made of an extruded polymer having fibers extending in the first direction and substantially parallel with said pair of slits;

grasping at least one tab;

pulling at least one tab thereby tearing the label sheet forming a pair of tear lines linearly aligned with said pair of slits;

further pulling the tab to remove a strip of the label sheet bounded by said tear lines and, wherein said second face of said label includes a deadened area bounded by an area between the tear lines such that the strip of label sheet is removed without interference by adhesive remaining on said second face.

6. A label, as claimed in claim 1, wherein:

said slits each have a length of about 1/16 inch.

7. A label, as claimed in claim 6, wherein:

said slits each have a length of about 1/16 inch.

8. A label, as claimed in claim 1, wherein:

said printing is applied at a location remote from said tab and said deadened area.

9. A label, as claimed in claim 5, wherein:

said printing is applied at a location remote from said tab and said deadened area.

* * * * *